US006079221A

United States Patent [19]

Senner

[11] Patent Number: 6,079,221

[45] Date of Patent: Jun. 27, 2000

[54] REFRIGERATOR WATER TANK

[75] Inventor: Kurt Charles Senner, Galesburg, Ill.

[73] Assignee: Maytag Corporation, Newton, Iowa

[21] Appl. No.: 09/132,760

[22] Filed: Aug. 12, 1998

[51] Int. Cl.[7] ..... F25D 23/12

[52] U.S. Cl. ..... 62/338; 62/389; 62/447; 165/168

[58] Field of Search ..... 652/389, 338, 652/447; 165/168, 170

[56] References Cited

U.S. PATENT DOCUMENTS

| | | | |
|---|---|---|---|
| 1,738,126 | 12/1929 | Stout . | |
| 2,096,481 | 10/1937 | Frykdahl . | |
| 2,477,210 | 7/1949 | Skinner . | |
| 2,644,316 | 7/1953 | Wyman, Jr. . | |
| 2,788,642 | 4/1957 | Burkhead et al. . | |
| 3,024,621 | 3/1962 | Parker . | |
| 3,429,140 | 2/1969 | White . | |
| 3,511,415 | 5/1970 | Crowe . | |
| 3,570,266 | 3/1971 | Alvarez et al. . | |
| 3,834,178 | 9/1974 | Pink . | |
| 3,982,406 | 9/1976 | Hanson et al. . | |
| 4,036,620 | 7/1977 | Benasutti et al. . | |
| 4,330,310 | 5/1982 | Tate et al. | 62/275 |
| 4,739,629 | 4/1988 | True . | |
| 5,156,021 | 10/1992 | St-Gelais et al. . | |
| 5,315,845 | 5/1994 | Lee . | |
| 5,349,832 | 9/1994 | Johnson et al. | 62/447 |
| 5,911,750 | 6/1999 | Mandel et al. | 62/407 |

*Primary Examiner*—Henry Bennett
*Assistant Examiner*—Chen-Wen Jiang
*Attorney, Agent, or Firm*—Everett G. Diederiks, Jr.

[57] ABSTRACT

A water tank having a body portion that slopes away, in multiple directions, from an outlet thereof is adapted to be mounted within a refrigerator cabinet in a substantially horizontal plane. The water tank is preferably integrally molded with multiple, parallel-arranged flow paths and with a plurality of upstanding tabs for use in mounting the water tank horizontally in a fresh food compartment of a refrigerator cabinet. The inlet and outlet areas of the tank are designed to minimize the potential for trapping air within the tank. In addition, the tank is formed with integrally molded clips for use in attaching a water tube to the tank. When used in a top mount refrigerator, the tank is particularly adapted to be mounted at a rear underside portion of a fresh food liner that forms part of a mullion divider assembly so as to be generally out of visual sight of the consumer, while being in direct heat exchange relationship with cooling air within the compartment.

20 Claims, 3 Drawing Sheets

REFRIGERATOR WATER TANK

BACKGROUND OF THE INVENTION

1. Field of the Invention

The present invention pertains to the art of refrigerators and, more particularly, to a horizontally mounted water tank used to store a supply of dispensable water from a refrigerator.

2. Discussion of the Prior Art

It is known to provide dispenser units in the front doors of refrigerators in order to enhance the accessibility to ice and/or water. Typically, such a dispenser unit will be formed in the freezer door of a side-by-side style refrigerator or in the fresh food or freezer door of a top mount style refrigerator. In either case, a water line will be connected to the refrigerator in order to supply the needed water for the operation of the dispenser. For use in dispensing the water, it is common to provide a water tank within the fresh food compartment to act as a reservoir such that a certain quantity of the water can be chilled prior to being dispensed.

Most dispenser equipped refrigerators available on the market today incorporate blow molded water tanks which are arranged vertically in lower sections of the fresh food compartments. More specifically, such a water tank is typically positioned behind a crisper bin or a meat keeper pan within a bottom section of the fresh food compartment so as to be subjected to the cooling air circulating within the compartment. Of course, locating the water tank in the bottom section of the fresh food compartment reduces the permissible size of the crisper bin and/or meat keeper. In addition, since the tank is not an aesthetically appealing feature of the refrigerator, it is generally hidden from view by a sight enhancing cover. Unfortunately, the cover reduces the direct exposure of the tank to the flow of cooling air, thereby minimizing the chilling effect for the water.

One concern with regard to the arrangement of a refrigerator water tank is to minimize the potential for air to become trapped within the tank. If air is trapped, the supply water in the tank will tend to compress the air during the dispensing operation. When the dispensing system is deactivated, the remaining air will expand and undesirably force an additional amount of water out of the dispenser. This is generally referred to as "run on" or "afterflow." Although the occurrence of afterflow is recognized in the art and therefore known water tanks are designed with this potential problem in mind, improvements in known water tank designs are still needed.

Based on the above, there exists a need in the art for an improved water tank arrangement for a refrigerator which will permit the tank to be more directly exposed to a flow of fresh food cooling air while maintaining the aesthetics of the compartment, increase the available storage space for a crisper bin and/or meat keeper pan of the refrigerator, and substantially eliminate the occurrence of afterflow.

SUMMARY OF THE INVENTION

The present invention is directed to the structure and mounting of a water tank in a general horizontal plane within a fresh food compartment of a refrigerator. The water tank includes a hollow body portion having an inlet adapted to be attached to a water supply line and an outlet adapted to be placed in fluid communication with a water dispensing fountain provided in a door of the refrigerator. When mounted, the water tank slopes away from the outlet in all directions and the outlet is located in an uppermost portion of the water tank. The mounting of the tank in this fashion is accomplished by providing varying height mounting tabs on opposed side portions of the water tank. The body portion also slopes away from the inlet in at least one direction. Furthermore, the inlet includes a stem that is angled upwardly and each of the inlet and the outlet is connected to the body portion through a respective converging section. By angling the inlet stem, providing the converging portions, locating the outlet in the uppermost portion of the tank and sloping the body portion of the tank in the manner described above, air will be automatically purged out of the system when the water tank is initially filled and potential air pockets are substantially eliminated. By eliminating these air pockets, undesirable afterflow of water following a dispensing operation is prevented.

When utilized in a top mount refrigerator, the water tank is preferably mounted in a generally horizontal plane to an underside of a mullion divider assembly and, more particularly, to an upper rear portion of the top wall of a fresh food liner that forms part of the mullion divider assembly. In this position, the water tank is located in a cooler area of the fresh food compartment and directly in the path of circulating air in order to yield a colder supply of water. In addition, visibility of the tank is minimized such that an extra cover or a sight enhancing enclosure is not required. Therefore, the water tank is directly exposed to the cooling air within the fresh food compartment to further enhance heat transfer. By placing the water tank at the top of the fresh food compartment, more usable space is created at the lower portion thereof such that larger crisper bins or the like can be provided. A similar result can be achieved when utilizing the water tank in a side-by-side refrigerator by placing the water tank under a shelf, such as a shelf that supports a slidable crisper bin or meat keeper. As meat keepers and crisper bins are typically provided with a direct flow of cooling air, locating the horizontal water tank of the present invention in these locations would enhance the chilling of the water, while also creating a potential for a larger fore-to-aft extending meat keeper or crisper bin.

Additional features and advantages of the water tank arrangement of the present invention will become more readily apparent from the following detailed description of a preferred embodiment thereof when taken in conjunction with the drawings wherein like reference numerals refer to corresponding parts in the several views.

DETAILED DESCRIPTION OF A PREFERRED EMBODIMENT

Figure 1:
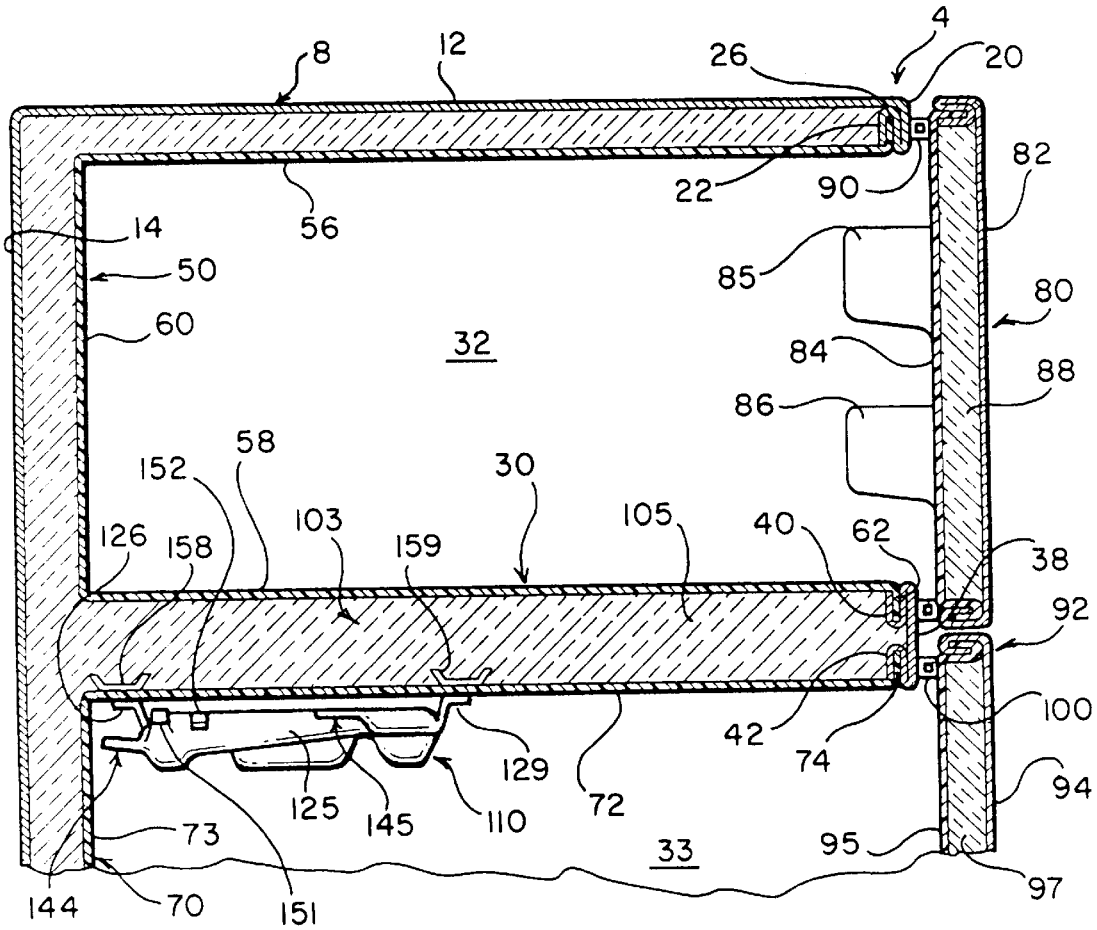
FIG. 1 is a partial cross-sectional view of a refrigerator cabinet having mounted therein a water tank constructed in accordance with the present invention.
Figure 2:
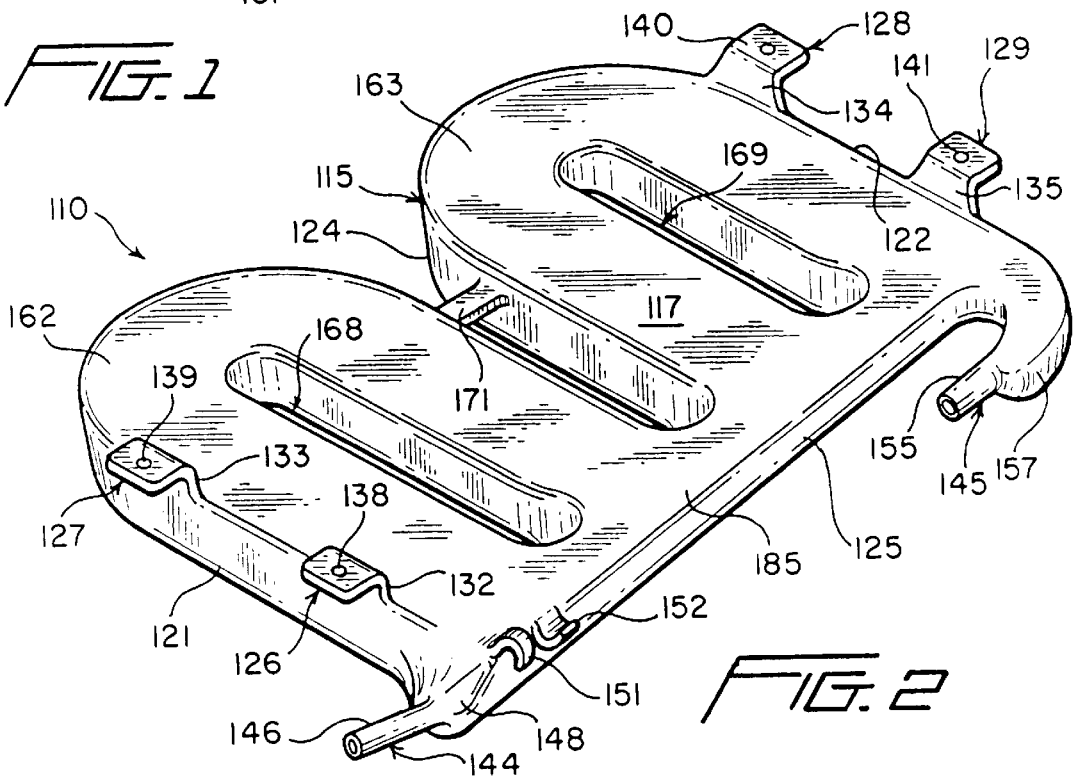
FIG. 2 is an upper perspective view of the water tank of the present invention.

With reference to FIG. 1, a top mount refrigerator cabinet incorporating the water tank arrangement of the present invention is generally indicated at 4. Refrigerator cabinet 4 comprises an outer shell 8 including opposed side panels (not shown), a top panel 12 and a back panel 14. As is known in the art, the side and top panels are preferably bent from a single blank of sheet metal and back panel 14 is attached thereto by a welding and/or crimping process. Each of the side and top panels are first roll-formed to create face portions, such as that indicated at 20 for top panel 12, of refrigerator cabinet 4 and then are roll-formed to create return flanges such as that indicated at 22. Each return flange 22 defines a portion of a liner receiving cavity 26. A mullion divider assembly 30 extends in a substantially horizontal plane across refrigerator cabinet 4 to divide refrigerator cabinet 4 into upper freezer and lower fresh food compartments 32 and 33. Although more specifics of mullion divider assembly 30 will be detailed below, at this point it should be noted that mullion divider assembly 30 includes a mullion bar 38 which extends across a front portion of outer shell 8 and which has associated upper and lower return flanges 40 and 42 that define respective liner receiving cavities (not separately labeled).

Within shell 8 is positioned a freezer liner 50. Freezer liner 50 is preferably integrally molded to define opposing side walls (not shown), a top wall 56, a bottom wall or floor 58 and a rear wall 60. An annular, out-turned flange 62 extends about the side, top and bottom walls at the front of shell 8. Flange 62 is actually positioned within the liner receiving cavities defined by return flanges 22 and 40 when mounting freezer liner 50 within shell 8. A fresh food liner 70 is similarly constructed with top and rear walls being shown at 72 and 73 respectively, as well as an out-turned flange 74 that is received within the liner receiving cavity of lower return flange 42. Of course, out-turned flange 74 is also positioned within additional receiving cavities (not shown) associated with shell 8.

In general, the mounting of freezer liner 50 and fresh food liner 70 is known in the art and is merely mentioned here for the sake of completeness. In addition, as is further common in the art, refrigerator cabinet 4 is provided with a pivotally mounted freezer door 80 to provide access to food items stored within freezer compartment 32. Freezer door 80 is constituted by an outer panel 82, a door liner 84 provided with item supporting dikes or shelves 85 and 86, foamed in-situ insulation 88 and an annular seal 90. In a similar manner, a refrigerator door 92 provides selective access to fresh food compartment 33 of refrigerator cabinet 4. The refrigerator door 92 also includes an outer panel 94, a door liner 95, insulation 97 and an annular seal 100. Since the particular structure and mounting of doors 80 and 92 are not considered part of the present invention and are widely known in the art, they will not be further discussed herein.

As mullion divider assembly 30 divides refrigerator cabinet 4 into upper and lower compartments 32 and 33 as discussed above, it should be apparent, in accordance with the present description, that mullion divider assembly 30 further includes the bottom wall or floor 58 of freezer liner 50 and the top wall 72 of fresh food liner 70. In addition, as clearly shown in FIG. 1, floor 58 is positioned vertically above top wall 72 such that a space 103 is provided therebetween. In the embodiment shown, space 103 is filled with foamed insulation 105. At this point, it should also be noted that constructing a mullion divider assembly for a top mount refrigerator in this fashion is extremely common in the art and therefore the term "mullion" has a specific meaning in the art. On top mount refrigerators, it is also common to provide a false floor within freezer compartment 32 such that space 103 can house one or more components of a refrigeration circuit, such as an evaporator. In any event, for the sake of simplicity, space 103 has merely been shown to be provided with insulation 105 at the cross-section taken for FIG. 1.

The present invention is particularly directed to the structure and mounting of a water tank, as indicated at 110 in FIG. 1, within refrigerator cabinet 4. With particular reference to FIGS. 2–6, the preferred construction for water tank 110 will now be described in detail. Water tank 110 is defined by a generally hollow body portion 115 having an upper surface portion 117, a lower surface portion 119, a rear portion 121, a front portion 122 and side portions 124 and 125 respectively. Extending upwardly above upper surface portion 117, at rear and front portions 121 and 122, are a plurality of mounting tabs 126–129. In the preferred embodiment, water tank 110 is blow molded of plastic and therefore mounting tabs 126–129 are integrally formed with body portion 115. Mounting tabs 126–129 include respective upstanding first legs 132–135 and generally horizontally extending second legs 138–141. In the preferred embodiment, mounting tabs 126–129 are arranged as sets with the first set being composed of mounting tabs 126 and 127 and the second set being composed of mounting tabs 128 and 129.

Figure 4:
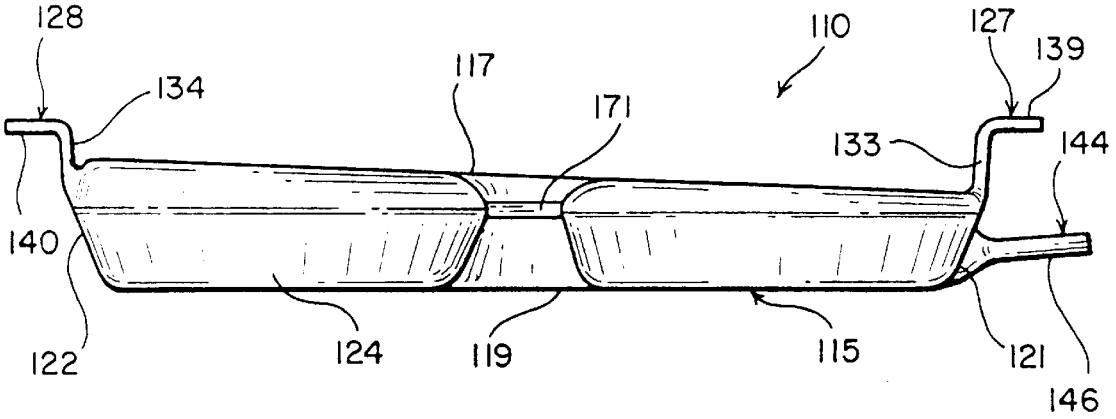
FIG. 4 is a right side elevational view of the water tank.
Figure 5:
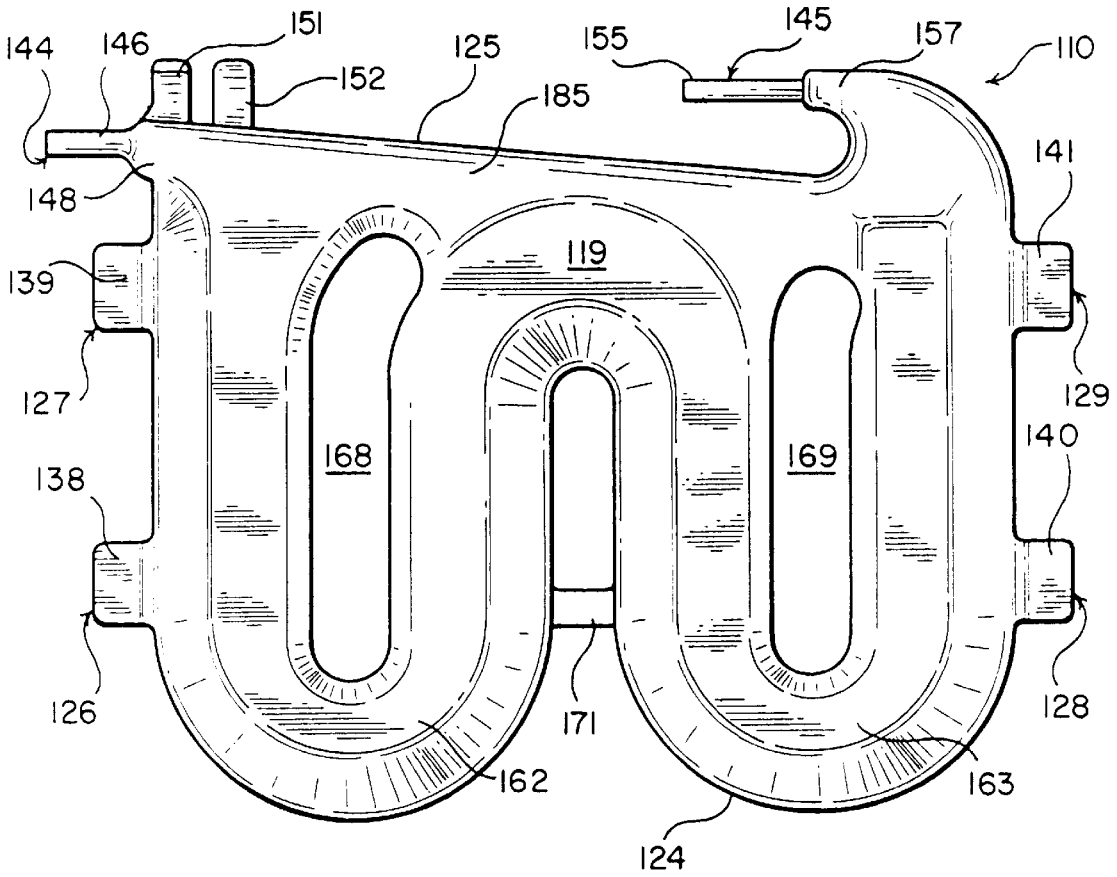
FIG. 5 is a bottom plan view of the water tank.
Figure 6:
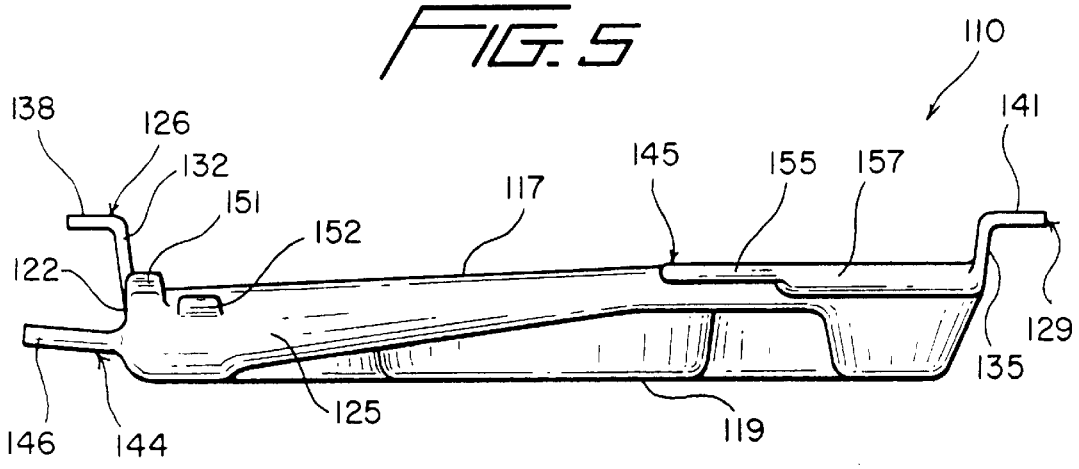
FIG. 6 is a left side elevational view of the water tank.

In the preferred embodiment, as perhaps best shown in FIG. 4, upper surface portion 117 of body portion 115 slopes downwardly from front portion 122 to rear portion 121. Therefore, mounting tabs 126 and 127 project vertically above upper surface portion 117 a distance greater than mounting tabs 129 and 128 respectively. In addition, body portion 115 further slopes from side portion 125 towards side portion 124, with mounting tab 127 projecting above upper surface portion 117 a distance greater than mounting tab 126 and mounting tab 128 projecting above upper surface portion 117 a distance greater than mounting tab 129. The reasons why body portion 115 preferably slopes in the directions described above will be further detailed below.

Figure 3:
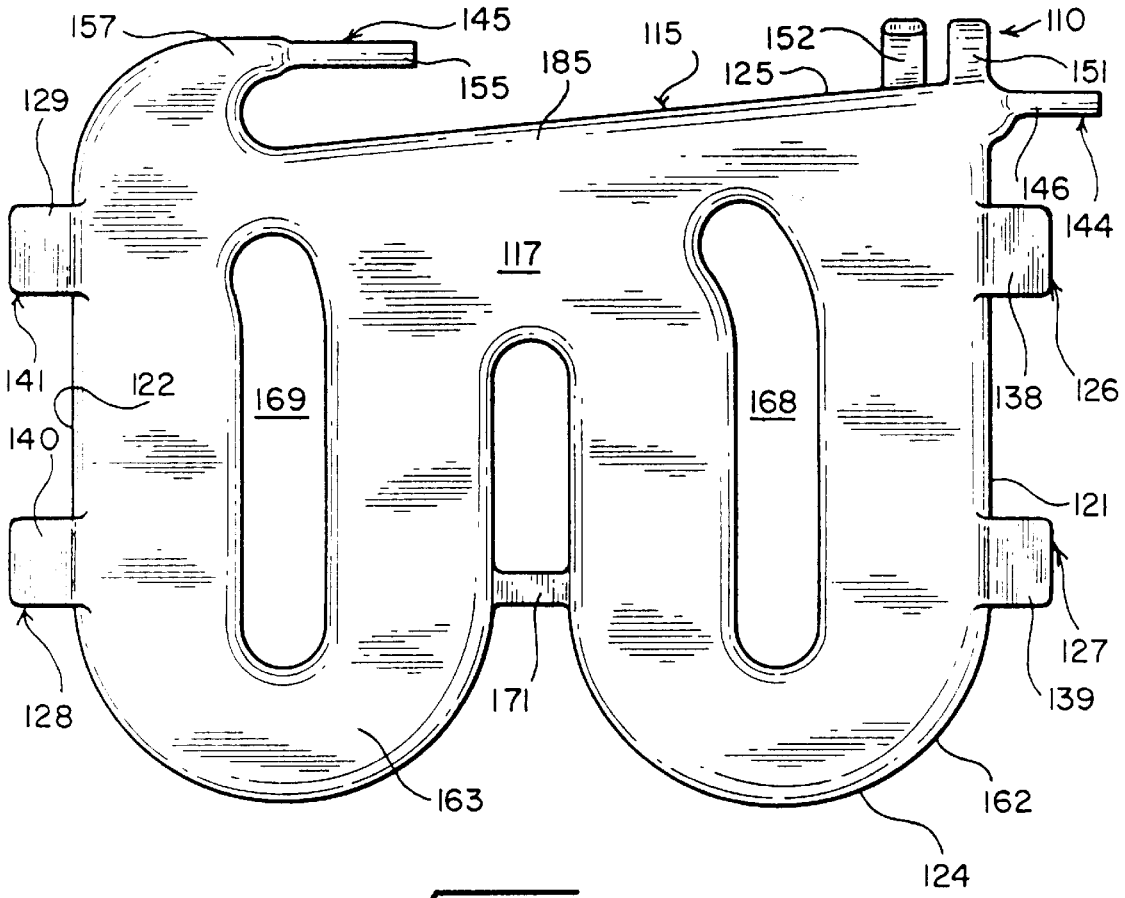
FIG. 3 is a top plan view of the water tank.

Hollow body portion 115 has an associated length defined between rear and front portions 121 and 122, a width defined as the distance between side portions 124 and 125 and a height defined in the distance between upper and lower surface portions 117 and 119. In the embodiment shown, water tank 110 has a length of approximately 11 inches (28 cm), a width of approximately 9 inches (23 cm) and a height of approximately 1.75 inches (4.5 cm). Of course, these dimensions are provided by way of example only in referring to the size of a preferred embodiment of the invention and are not intended to be a limiting feature of the invention. Water tank 110 is provided with an inlet 144 leading into hollow body portion 115 and an outlet 145. Inlet 144 is provided with a stem portion 146 that is attached to body portion 115 through a converging section 148. In the preferred embodiment, stem 146 extends upwardly from body portion 115 at an acute angle and is located in a rear section of rear portion 121, with the rearwardmost portion (not labeled) of stem 146 being substantially in line with side portion 125 as best shown in FIG. 3. Again the particular reason for this preferred construction will be detailed below.

A water supply tube (not shown) is adapted to be attached to inlet 144 for supplying a source of water to tank 110, with the supply tube being fitted about stem 146. Adjacent inlet 144, along side portion 125, body portion 115 is formed with a pair of spaced clip members 151 and 152. In general, clip members 151 and 152 are U-shaped with clip member 151 being inverted relative to clip member 152. Outlet 145 is also formed with a stem 155 that leads to body portion 115 through a neck portion 157. It should be noted that stem 155 is located at an uppermost portion of water tank 110 (see FIGS. 1 and 6) and is adapted to be attached to a discharge tube for supplying the water to a dispenser which, in the embodiment shown, is preferably formed in refrigerator door 92. Clip members 151 and 152 function to retain the discharge tube in a desired position along side portion 125.

The routing of the tubes to and from water tank 110 can be accomplished in numerous ways without departing from the spirit of the invention. When utilized in a top mount refrigerator cabinet 4 as indicated in FIG. 1, water tank 110 is preferably directly mounted to the underside of mullion divider assembly 30, i.e., top wall 72 of fresh food liner 70, by means of a plurality of brackets or anchors, such as those shown at 158 and 159 in FIG. 1. Anchors 158 and 159 are preferably foamed in place within space 103, but can be attached to liner 70 with an adhesive, mechanical fasteners or can either be integrally formed with liner 70. In any event, the supply tube will be preferably routed between liner 70 and back panel 14 while projecting through rear wall 73 of liner 70 adjacent water tank 110. The tube leading from water tank 110 to the dispenser can either be directed through mullion divider assembly 30 and into refrigerator door 92 of the top mount refrigerator cabinet 4 through a center hinge (not shown) or can follow a similar path to the supply line back to the bottom of the refrigerator cabinet 4, extend across the bottom thereof, and enter the refrigerator fresh food door 92 through or at a lower door hinge (not shown). In any event, what is important to note at this point is the ability of water tank 110 to be mounted to mullion divider assembly 30 in a generally horizontal plane and at an upper rear portion of fresh food compartment 33. In this location, water tank 110 is directly exposed to cooling air flowing within fresh food compartment 33 and is generally out of sight of the consumer, even without the need to provide a supplemental, aesthetics enhancing cover.

Body portion 115 of water tank 110 defines multiple water flow paths from inlet 144 to outlet 145. One of these flow paths is constituted by a serpentine path defined by two generally U-shaped sections 162 and 163 of water tank 110. A second path is defined by a connecting section 185 which generally runs along side portion 125 of water tank 110. Therefore, the water entering water tank 110 through inlet 144 can flow to outlet 145 in multiple, parallel-arranged flow paths. In the center of each of the U-shaped sections 162 and 163 is defined a respective void 168 and 169 and a reinforcing rib 171 is provided to interconnect U-shaped sections 162 and 163.

With this construction of water tank 110, upper surface portion 117 is angled downward in all directions from outlet 145. Upper surface portion 117 is angled in a direction perpendicular to side portion 125 such that air cannot be trapped in water tank 110 even when refrigerator cabinet 4 is installed on a slightly unleveled location. Upper surface portion 117 is also angled as described above to allow a smooth path for air bubbles to be discharged from the tank. By angling stem 146 in the manner described above, air will tend to be purged out of the system when water tank 110 is initially filled. Stem 146 of inlet 144 is located in a low area of converging section 148 and stem 155 of outlet 145 is located in a high area of neck portion 157 so as to eliminate potential air pockets in order to prevent afterflow of water following a dispensing operation. Actually, outlet 145 is preferably located at an uppermost tank area.

By placing water tank 110 in a horizontal position as defined by the length, width and height dimensions of water tank 110, not only can water tank 110 be placed where visibility will be minimized to the customer, but it will be located in a cooler area of the fresh food compartment, particularly given known air circulation paths. Thus, water from tank 110 will be of a lower temperature yielding a consumer a colder supply of water. Since water tank 110 is generally not visible, an extra cover or sight enhancing enclosure is not required and therefore water tank 110 is directly exposed to the cooling air within fresh food compartment 33. This direct exposure enhances heat transfer so as to achieve a better performing, chilled water tank arrangement at a reduced cost. In addition, by placing water tank 110 at the top of fresh food compartment 33, more usable space now exists at the lower portion of fresh food compartment 33 such that larger crisper bins or the like can be provided.

Although described with respect to the preferred embodiment of the invention, it should be readily understood that various changes and/or modifications can be made to the invention without departing from the spirit thereof. For example, although the horizontal water tank of the present invention is particularly described with respect to its use in a top mount refrigerator, it should be understood that the water tank arrangement could also be incorporated in a side-by-side refrigerator while achieving similar advantages. For example, when used in a side-by-side refrigerator, water tank 110 would be mounted horizontally under a shelf, such as above a meat keeper or crisper pan, in order to reduce visibility and the potential for afterflow, while also creating a potential for a larger fore-to-aft extending meat keeper or crisper bin. As meat keeper and crisper bins are generally provided with a direct flow of cooling air, locating the horizontal water tank of the present invention in these locations would still enable increase chilling of the water over known prior art arrangements. However, in general, the invention is only intended to be limited by the scope of the following claims.

I claim:

1. A refrigerator cabinet comprising:

an outer cabinet shell defining an interior chamber;

a mullion divider assembly extending within the interior chamber of said outer cabinet shell in a generally horizontal plane, said mullion divider assembly separating the interior chamber into an upper freezer compartment and a lower fresh food compartment, said mullion divider assembly having an upper surface and a lower surface; and a water tank including a body portion having associated length, width and height dimensions with each of said length and width dimensions being multiple times greater than said height dimension, said body portion including an inlet adapted to be attached to a water supply source and an outlet for delivering water from the water tank, said water tank being mounted to the lower surface of said mullion divider assembly with said body portion extending in a generally horizontal plane.

2. The refrigerator cabinet according to claim 1, further comprising upper and lower compartment defining liners mounted within said outer cabinet shell, said mullion divider assembly including a mullion bar, which extends laterally across a front end portion of said outer cabinet shell, a floor portion of said upper compartment liner and a top portion of said lower compartment liner, said water tank being mounted directly to the top portion of said lower compartment liner.

3. The refrigerator cabinet according to claim 2, wherein said lower compartment liner includes a rear wall portion, said water tank being mounted to the top portion of said lower compartment liner, directly adjacent said rear wall portion.

4. The refrigerator cabinet according to claim 3, wherein at least one of said inlet and said outlet is located at a rear portion of said water tank, directly adjacent said rear wall portion.

5. The refrigerator cabinet according to claim 1, wherein said water tank includes first and second flow channels fluidly interconnecting, in parallel, said inlet and said outlet.

6. The refrigerator cabinet according to claim 1, wherein said outlet is located vertically higher than said inlet.

7. The refrigerator cabinet according to claim 1, wherein the body portion of said water tank slopes downwardly from said outlet to said inlet.

8. The refrigerator cabinet according to claim 7, wherein said body portion includes front and rear portions, with said inlet being located closer at said rear portion than said outlet, said body portion sloping downwardly from said front portion to said rear portion.

9. The refrigerator cabinet according to claim 1, wherein said inlet includes a stem portion, said stem portion being angled upwardly.

10. The refrigerator cabinet according to claim 1, wherein said water tank is molded of plastic, said body portion being integrally formed with a plurality of upstanding mounting tabs.

11. The refrigerator cabinet according to claim 10, wherein said plurality of upstanding mounting tabs are arranged as first and second, laterally spaced tab sets, said first tab set extending vertically above the body portion of said water tank a distance greater than said second tab set.

12. The refrigerator cabinet according to claim 1, further comprising at least one mounting clip connected to the body portion of said water tank, said at least one mounting clip being adapted to attach a water tube to said water tank.

13. The refrigerator cabinet according to claim 1, wherein the body portion slopes away from the outlet in all directions.

14. A water tank for use in a refrigerator cabinet comprising: a body portion having associated length, width and height dimensions with each of said length and width dimensions being multiple times greater than said height dimension, said body portion including an inlet adapted to be attached to a water supply source and an outlet for delivering water from the water tank, said water tank being adapted to be mounted, in a generally horizontal plane, within the refrigerator cabinet, with said body portion sloping away from the outlet in all directions, wherein the body portion of said water tank includes front, rear and first and second spaced side portions, said inlet being located closer to said rear portion than said outlet and wherein said body portion slopes downwardly from said front portion to said rear portion.

15. The water tank according to claim 14, wherein said water tank includes first and second flow channels fluidly interconnecting, in parallel, said inlet and said outlet.

16. The water tank according to claim 14, wherein said outlet is adapted to be positioned vertically higher than said inlet during use of said water tank.

17. The water tank according to claim 14, wherein said body portion further slopes downward from the first side portion towards the second side portion, said inlet and said outlet each being located closer to said first side portion than said second side portion.

18. The water tank according to claim 14, wherein said water tank is molded of plastic, said body portion being integrally formed with a plurality of upstanding mounting tabs and wherein said plurality of upstanding mounting tabs are arranged as first and second, laterally spaced tab sets, said first tab set extending vertically above the body portion of said water tank a distance greater than said second tab set.

19. A water tank for use in a refrigerator cabinet comprising:

a body portion having associated length, width and height dimensions with each of said length and width dimensions being multiple times greater than said height dimension, said body portion including an inlet adapted to be attached to a water supply source and an outlet for delivering water from the water tank, said water tank being adapted to be mounted, in a generally horizontal plane, within the refrigerator cabinet, with said body portion sloping away from the outlet in all directions; and at least one mounting clip attached to the body portion of said water tank, said at least one mounting clip being adapted to attach a water tube to said water tank.

20. The water tank according to claim 14, wherein the body portion of said water tank includes front, rear and first and second spaced side portions, said inlet being located closer to said rear portion than said outlet and wherein said body portion slopes downwardly from said front portion to said rear portion.

* * * * *